US009790644B2

(12) United States Patent
Hansen

(10) Patent No.: US 9,790,644 B2
(45) Date of Patent: Oct. 17, 2017

(54) VERTICAL RIDE QUALITY SYSTEM FOR A RAIL VEHICLE

(71) Applicant: HARSCO TECHNOLOGIES LLC, Fairmont, MN (US)

(72) Inventor: Kevin Hansen, Ludington, MI (US)

(73) Assignee: Harsco Technologies LLC, Fairmont, MN (US)

( * ) Notice: Subject to any disclaimer, the term of this patent is extended or adjusted under 35 U.S.C. 154(b) by 2 days.

(21) Appl. No.: 14/968,372

(22) Filed: Dec. 14, 2015

(65) Prior Publication Data

US 2017/0167083 A1 Jun. 15, 2017

(51) Int. Cl.

| | |
|---|---|
| ***E01B 27/00*** | (2006.01) |
| ***B61F 99/00*** | (2006.01) |
| ***B61C 17/04*** | (2006.01) |
| ***B61D 15/00*** | (2006.01) |
| *E01B 27/16* | (2006.01) |
| *F15B 13/043* | (2006.01) |

(52) U.S. Cl.

CPC ..... *E01B 27/00* (2013.01); *B61C 17/04* (2013.01); *B61D 15/00* (2013.01); *B61F 99/00* (2013.01); *E01B 27/16* (2013.01); *F15B 13/0435* (2013.01); *F15B 2211/40507* (2013.01); *F15B 2211/40515* (2013.01); *F15B 2211/6355* (2013.01)

(58) Field of Classification Search

CPC ..... E01B 27/00; E01B 27/16; B61C 13/00; B61F 99/00

See application file for complete search history.

(56) References Cited

U.S. PATENT DOCUMENTS

| | | | | |
|---|---|---|---|---|
| 2014/0261048 | A1* | 9/2014 | Carter | B61D 15/00 104/12 |
| 2015/0152900 | A1* | 6/2015 | Egawa | E02F 9/2285 60/419 |
| 2015/0300378 | A1* | 10/2015 | Udagawa | E02F 3/32 60/449 |
| 2016/0047091 | A1* | 2/2016 | Krusniak | E01B 27/16 104/12 |

FOREIGN PATENT DOCUMENTS

| | | |
|---|---|---|
| JP | 06287904 | 10/1994 |
| JP | 2010261192 | 11/2010 |

OTHER PUBLICATIONS

International search report and written opinon of the international searching authority for co-pending PCT application No. PCT/US2016/061079 dated Feb. 7, 2017.

* cited by examiner

*Primary Examiner* — Jason C Smith
(74) *Attorney, Agent, or Firm* — Baker & McKenzie LLP

(57) ABSTRACT

A rail maintenance vehicle includes a frame, a workhead, an actuator, a pilot valve, and a throttling valve. The frame includes wheels that travel along rails. The actuator extends and retracts the workhead with respect to the frame. The pilot valve receives a fluid and controls the flow of the fluid to at least one output. The throttling valve adjusts a pressure of the fluid at an output relative to a pressure of the fluid at an input. The pilot valve and the throttle valve are coupled such that the fluid travels through the pilot valve and the throttling valve to cause the workhead to be extended or retracted.

20 Claims, 4 Drawing Sheets

VERTICAL RIDE QUALITY SYSTEM FOR A RAIL VEHICLE

BACKGROUND

Generally, railroad tracks include a pair of parallel rails coupled to a series of laterally extending ties (or sleepers). Ties may be made from concrete or wood. Each tie is coupled to the rails by metal tie plates and/or spring clips. The ties are disposed on a ballast bed. The ballast may be a hard particulate material, such as gravel. The ballast filled space between the ties is called a crib.

Although appearing rigid, rails are flexible members that can bend and distort, for example under the load of trains passing over. The ballast acts like a cushion absorbing some of the shock. Ballast can also help keep the rail level and allow moisture and rain water to drain away.

During installation and maintenance, ballast may be "tamped" to maintain proper position of the ties. Tamping involves agitating the ballast to allow the particles to re-position, and compact it under the tie.

A tamping device includes one or more workheads mounted on a motorized vehicle that travels on the rails. A workhead may include a pair of elongated, vertically extending tools structured to move together vertically and horizontally in a pincer-like motion. The workhead has two sets of tools spaced so that each tool may be disposed on opposite lateral sides of a rail. The workhead may further include a vibration device configured to rapidly vibrate the tools.

A tamping vehicle typically carries at least one operator. The vehicle accelerates under its own power to the ties requiring work. As it approaches the tie, it slows down, then stops at a tie and performs the required tamping work, and moves to the next tie to repeat the cycle. Tamping work may involve agitating and compacting the ballast through the vertical movement and vibration of the workhead. The constant movement and vibration of the tamping device may cause discomfort to operators sitting in tamping vehicles for extended periods of time.

BRIEF SUMMARY

In an example, a rail maintenance vehicle includes a frame, a workhead, an actuator, a pilot valve, and a throttling valve. The frame includes wheels that travel along rails. The actuator extends and retracts the workhead with respect to the frame. The pilot valve receives a fluid and controls the flow of the fluid to at least one output. The throttling valve adjusts a pressure of the fluid at an output relative to a pressure of the fluid at an input. The pilot valve and the throttle valve are coupled such that the fluid travels through the pilot valve and the throttling valve to cause the workhead to be extended or retracted.

In another example, a method of operating a maintenance vehicle includes: supplying fluid to a pilot valve; supplying the fluid to a throttling valve that adjusts a pressure of the fluid at an output relative to a pressure of the fluid at an input; and controlling an actuator that extends and retracts a workhead relative to a frame of the vehicle using the fluid exiting the throttling valve.

DETAILED DESCRIPTION

Embodiments of a vertical ride quality system and related methods for reducing the vertical vibration in a rail vehicle are described. It is to be understood, however, that the following explanation is merely exemplary in describing the devices and methods of the present disclosure. Accordingly, any number of reasonable and foreseeable modifications, changes, and/or substitutions are contemplated without departing from the spirit and scope of the present disclosure.

Figure 1:
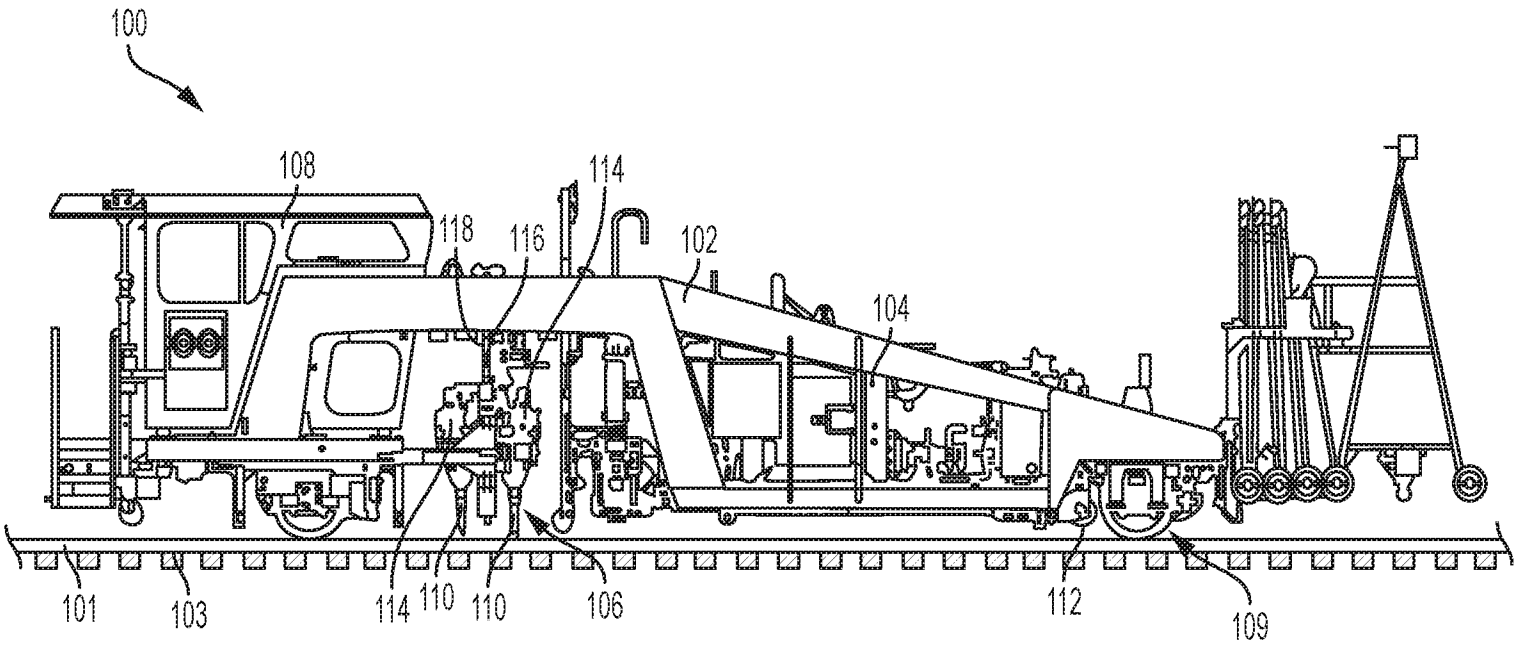
FIG. 1 shows a tamping machine rail vehicle where a vertical ride quality system can be implemented, according to an example embodiment.

In an embodiment, the vertical ride quality system is employed in a tamping machine rail vehicle, as illustrated in FIG. 1. FIG. 1 shows a tamping vehicle 100 that includes a frame assembly 102, a propulsion device 104, a tamping device 106, and a cabin 108. Frame assembly 102 includes a plurality of rigid frame members and a plurality of wheels 109 that are configured to travel on the pair of rails 101. Tamping vehicle 100 travels across a pair of rails 101, disposed over a series of rail ties 103. The rails 101 and series of ties 103 are disposed over a bed of ballast. The propulsion system 104 is configured to move tamping vehicle 100. The tamping device 106 is configured to tamp rail ties 103.

The tamping device 106 may include multiple workheads. In the side view of FIG. 1, one workhead can be viewed while another workhead is also included at an opposite side corresponding with the other rail. Any number of workheads (2, 4, etc) may be included. The tamping device 106 includes paddles 110 that are lowered into the ballast. The paddles 110 are vibrated by vibrators 114. The paddles 110 may be actuated by an actuator, which may be hydraulic, to squeeze the paddles around the rail ties. The tamping device 106 is coupled to the frame assembly 102 via a subframe 116 and an actuator 118. The actuator 118 is preferably a hydraulic actuator and is operable to lower the tamping device 106 such that the paddles 110 are inserted into the ballast where the squeezing and vibration action tamps the ballast. In a work cycle, the tamping vehicle 100 advances to position the tamping device 106 over a tie. The actuator 118 is actuated to lower the tamping device 106 to carry out the tamping of the ballast. Then, the actuator 118 is actuated to raise (and in some cases stow) the tamping device 106 for travel to the next tie.

Tamping vehicle 100 may also include a tracking device 112 that measures the general linear movement of the rail vehicle 100 along the rail track 101. Cabin 108 may be structured such that it remains stationary relative to the frame assembly 102 as the rail vehicle 100 moves along the railroad track 101.

Figure 2:
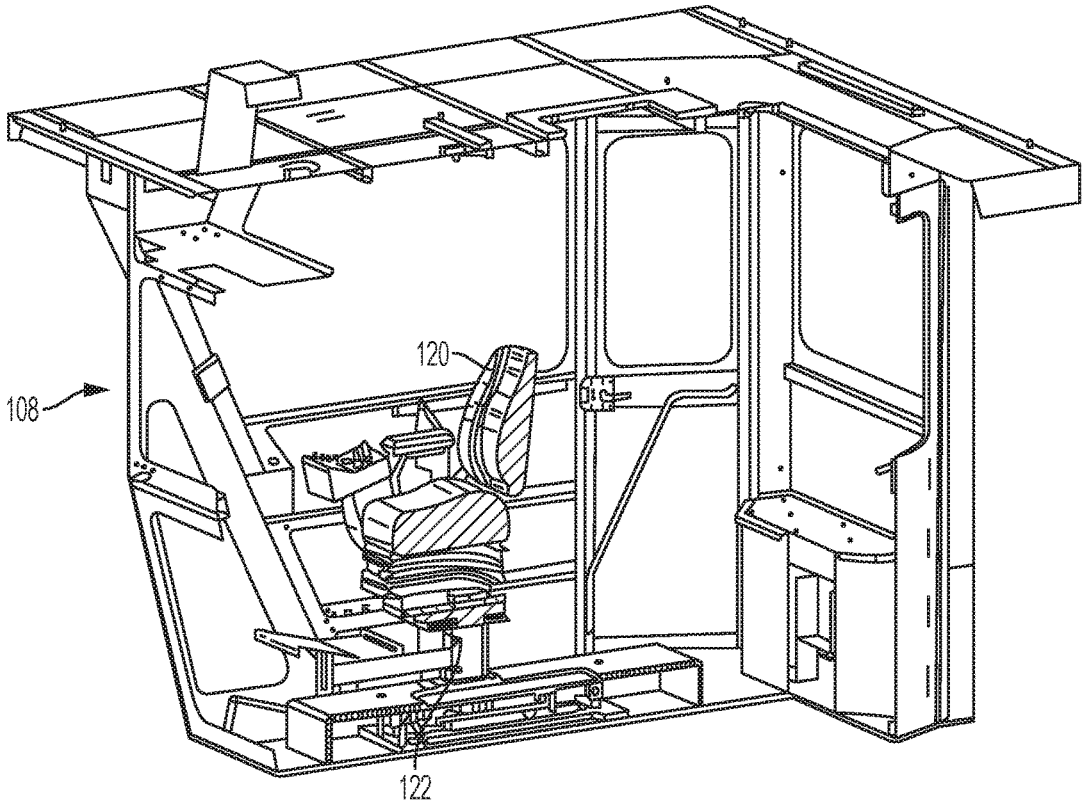
FIG. 2 shows a seat assembly where a vertical ride quality system can be implemented, according to an example embodiment.

FIG. 2 shows a seat assembly 120 located within cabin 108. An operator may sit on the seat and control the tamping machine rail vehicle 100 from within the cabin during a tamping or other operation. To reduce movement or vibrations felt by an operator in the seat assembly 120, the seat assembly 120 may include a suspension 122 such as a pneumatic or air bag suspension to dampen vibrations in the seat assembly 120. The effect of the suspension 122 is limited in that it operates to lessen vibrations passing through to the seat assembly 120. The suspension 122 does not lessen the stresses induced in the remainder of the tamping vehicle 100. Vertical ride quality felt by an operator (e.g., vibration) as well as the stresses induced in the tamping vehicle 100 may be reduced by limiting the vertical impact at the source.

Figure 3:
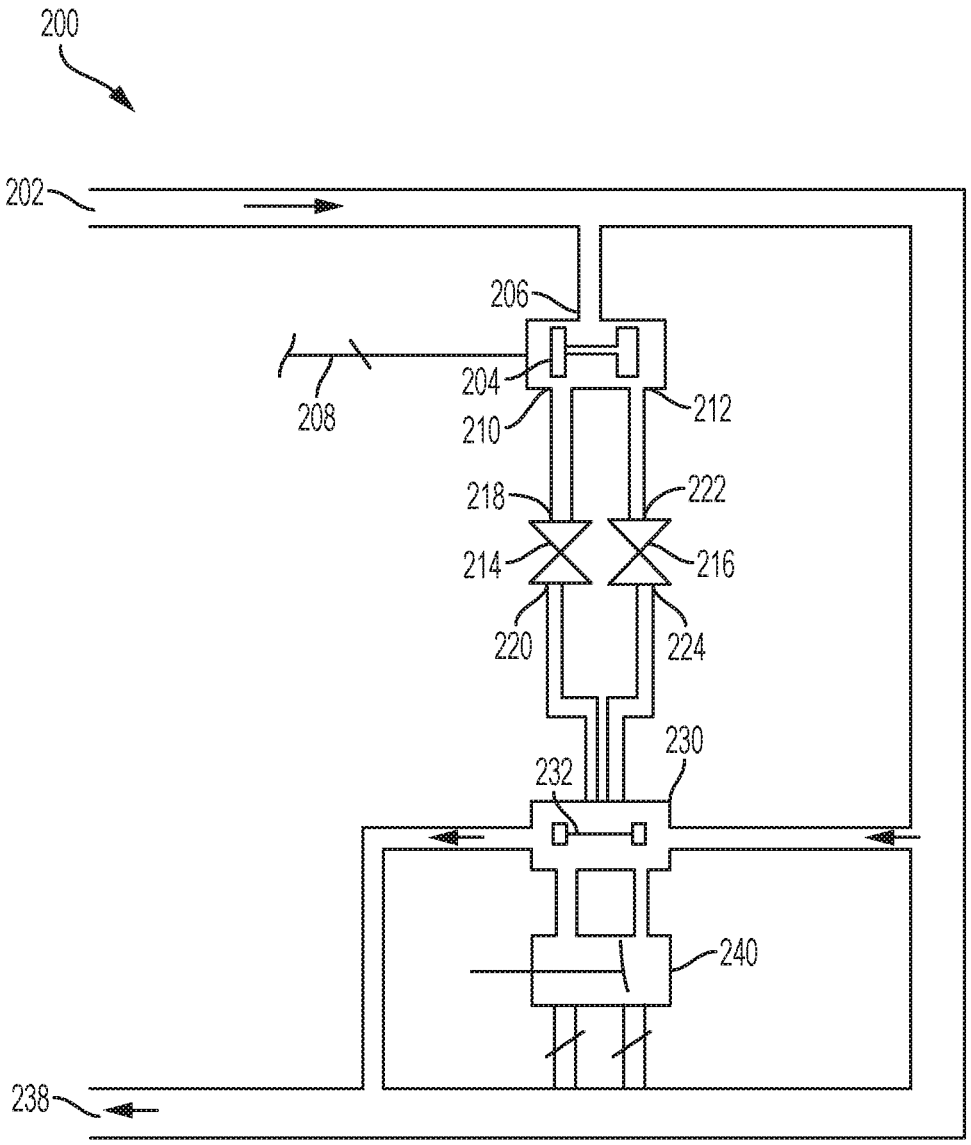
FIG. 3 is a schematic of a control system, according to an example embodiment.

Referring to FIG. 3, a control system 200 for controlling the raising and lowering of the workheads (and thereby the impact induced on the operator and the tamping vehicle 100) is illustrated. Hydraulic fluid (or any other fluid such as engine oil) is supplied by a source 202, for example, an accumulator or the output of a hydraulic pump. The hydraulic fluid is supplied to a pilot valve 204 via an orifice 206. The pilot valve 204 may be an electronically controlled valve such as a solenoid valve controlled via control wires 208. The pilot valve 204 is illustrated as a three way valve having an input orifice 206 and two outputs 210 and 212. The pilot valve may selectively direct hydraulic fluid to the output 210, the output 212 or neither output. Other configurations (for example two solenoid valves) may also be used. The outputs 210 and 212 may be respectively coupled to the throttling valves 214 and 216. The throttling valves 214/216, which may be gate valves, are operable to reduce a pressure of the hydraulic fluid such that a pressure at an output side 220/224 is lower than at an input side 218/222 based on the setting of the throttle valves 214/216. The setting of the throttling valves 214/216 may be adjusted via a threaded stem coupled to the gate of the valve.

The output sides 220/224 of the throttling valves 214/216 may be coupled to a spool 232 of the main valve 230. The hydraulic fluid from the throttling valves 214/216 controls the position of the spool 232, which in turn sets the speed and direction of the actuator 240. After passing the spool 232, the hydraulic fluid may be supplied to the main valve 230 or may be directed to the return 238. The main valve 230, based upon the position of the spool 232, directs hydraulic fluid from the source 202 to the actuator 240, which causes the tamping workhead to raise or lower. Hydraulic fluid may return via return 238.

In an example, the throttling valve 214 may be associated with the compression stroke of the actuator 240, which may in turn correspond to raising the tamping workhead. The throttling valve 216 may be associated with the extension stroke of the actuator 240, which may in turn correspond to lowering the tamping workhead.

In an example, the orifice 206 may be enlarged (for example 1 mm as compared to 0.8 mm) to provide a greater range of available pressures at an output side 220/224 of the throttling valves 214/216. Conversely, a smaller orifice (for example 0.8 mm as compared to 1.0 mm) may be used to reduce an upper limit as to how fast the main valve 230 can change direction and stroke of the actuator 240. The size of the orifice controls the speed at which the pilot valve 204 shifts, which in turn (after passing through the throttling valves) controls the speed at which the spool 232 shifts. Controlling the rate at which the spool 232 of the main valve 230 shifts reduces the acceleration of the actuator 240.

In operation, the pilot valve 204 may select whether hydraulic fluid is directed to lift or lower the tamping workhead. The throttling valve 214/216, based upon its setting, affects how quickly the spool in the main valve 230 moves by changing the pressure and/or flow rate of the hydraulic fluid reaching the spool.

The throttling valve 214/216 may reduce the impact induced in the tamping vehicle 100, and by extension the operator, by controlling how quickly the tamping workhead is inserted into and removed from the ballast. In the example where two throttling valves are included, the up stroke and the down stroke may be individually controlled. This allows the advantage of adjusting the stroke that is causing the most induced impact while allowing faster action on the other stroke to improve workhead cycle time. For example, the pressure to the side of the spool associated with raising the workhead may be limited more than the pressure to the side of the spool associated with lowering the workhead. It will be appreciated that multiple throttling valves may be provided for each workhead. For example, if the vehicle includes four workheads, there may be eight throttling vales to independently control the up and down stroke of each workhead individually.

Figure 4:
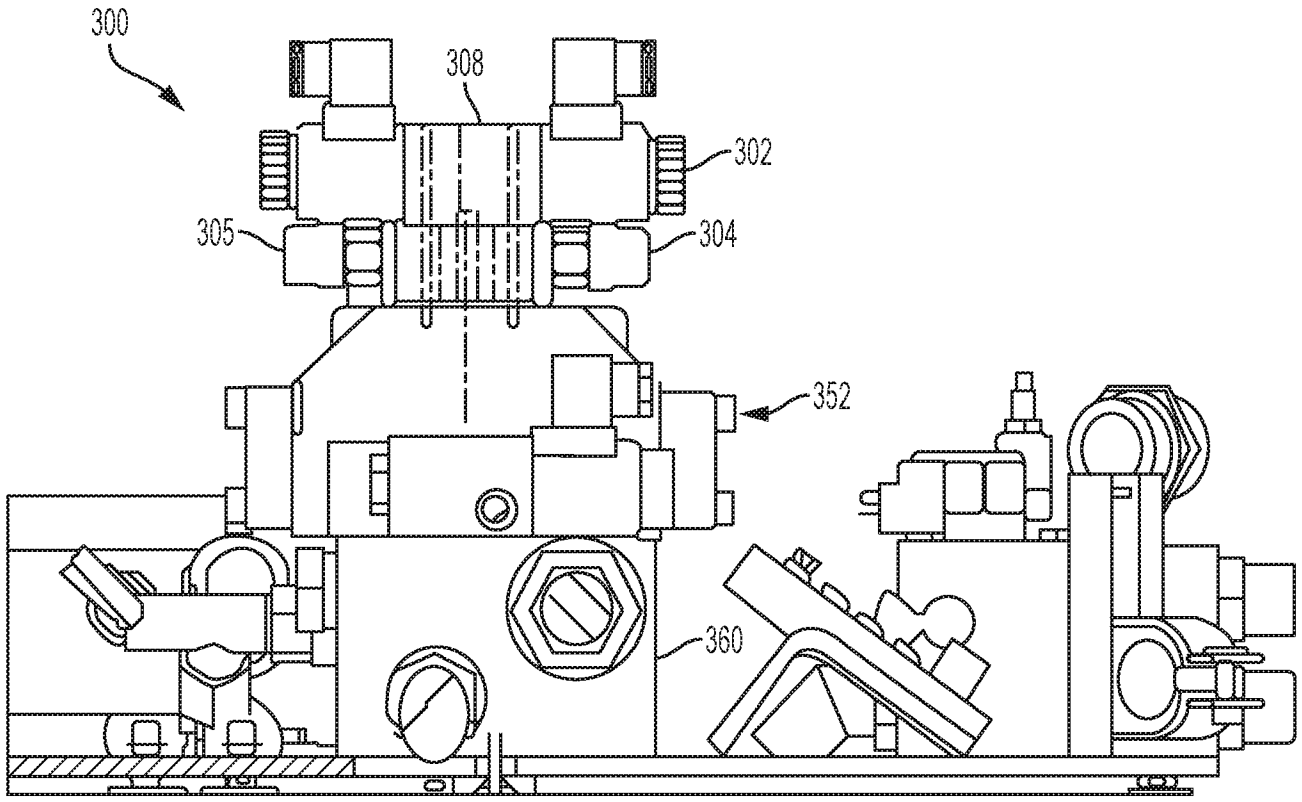
FIG. 4 shows a side view of an aspect of a vertical ride quality system, according to an example embodiment.

FIG. 4 is a side view of a portion of a vertical ride quality system 300. Vertical ride quality system 300 may include a series of control valves that may provide a dampening effect to the vehicle and thereby also the seat assembly 120. Vertical ride quality system 300 includes a pilot valve 302 and throttling valves 304 and 305, which may be provided by a single twin valve. The system 300 is coupled to an engine and a main control valve 352 of a workhead. Pilot valve 302 receives oil pumped from the engine via an orifice 308 and causes the oil to flow through the throttling valve 304 (or 305 based on the setting of the pilot valve 302) and into the main control valve 352.

The engine drives a pump that supplies oil (or another hydraulic fluid) to the main control valve 352. In an embodiment, orifice 308 is connected to this pump, and oil is ported so that it goes through the pilot valve 302, throttling valve 304, main control valve 352 and back into the engine spool. Oil delivered through orifice 308 controls the movement and speed of a spool of the main control valve 352 thereby controlling the acceleration of an actuator coupled to the main control valve 352, which in turn controls impacts and vibrations experienced by the vehicle, and thus also the movement of seat assembly 120. By controlling the flow of the oil, valves 302, 304, and 352 collectively dampen the actuator and by extension the vibration of seat assembly 120. Throttling valves 304 and 305 control the speed of the spool that shifts directions of the main control valve 352. Throttling valves 304/305 may be of a gate valve type that include a knob and a faucet. The main control valve 352 controls the vertical movement of a workhead of tamping device 106.

In an embodiment, manifold 360 includes one or more main control valves 352 for each of the one or more workheads of tamping device 106. For example, the manifold 350 may include four main control valves 352 respectively associated with four workheads.

In an embodiment, the engine drives a pump that supplies oil to manifold 360. Orifice 308 is connected to this pump, and oil is ported so that it goes through the pilot valve 302, throttling valve 304/305 (which also may be included as a part of the manifold 360), main control valve 352 and back into the engine spool. The throttling valve 304/305 controls how fast the spool in the main control moves and the amount of oil that respectively flows into that one of the four main valves 352.

In an embodiment, system 300 includes two throttling valves, valves 304 and 305. The pair of throttling valves may be manually and individually adjustable. In an embodiment, a first throttling valve, for example valve 304, may affect the down stroke of one or more workheads, and a second throttling valve, for example, valve 305, may affect the up stroke of one or more workheads. In an embodiment, the twin throttle valves can be adjusted to avoid significantly prolonging the workhead cycle yet still provide dampening of system 300. In this manner, the pair of throttling valves

304 and 305 can be adjusted by an operator to control the shifting time of the pilot valve 302 and the main control valve 352.

It will be appreciated that twin throttling valves are not required. For example, a single throttling valve may be used in place of the twin throttle valves. The throttling valves may also be disposed at different locations in the system. For example, the throttling valve may also be placed before the pilot valve.

It will also be appreciated that this disclosure is not limited to rail vehicles that carry an operator. For example, an autonomous or drone vehicle can also realize advantages of the present disclosure such as reduced mechanical stresses on various parts of the vehicle.

The breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

The invention claimed is:

1. A rail maintenance vehicle, comprising:

a frame having wheels that travel along rails;

a workhead;

an actuator that extends and retracts the workhead with respect to the frame;

a pilot valve that receives a fluid and controls the flow of the fluid to at least one output;

a throttling valve that adjusts a pressure of the fluid at an output relative to a pressure of the fluid at an input, wherein the pilot valve and the throttle valve are coupled such that the fluid travels through the pilot valve and the throttling valve to cause the workhead to be extended or retracted.

2. The rail maintenance vehicle of claim 1, further comprising a main control valve disposed between the throttling valve and the actuator with respect to flow of the fluid.

3. The rail maintenance vehicle of claim 2, wherein the main control valve includes a spool that determines, based on its position, at least one of the direction and speed the workhead extends or retracts, and the throttling valve supplies the fluid to the spool.

4. The rail maintenance vehicle of claim 1, wherein the pilot valve is a solenoid valve.

5. The rail maintenance vehicle of claim 1, wherein the throttling valve is a gate valve.

6. The rail maintenance vehicle of claim 1, wherein the pilot valve supplies the fluid to the throttling valve.

7. The rail maintenance vehicle of claim 1, further comprising a second throttling valve.

8. The rail maintenance vehicle of claim 7, wherein the pilot valve selectively supplies the fluid to one of the throttling valve and the second throttling valve.

9. The rail maintenance vehicle of claim 7, further comprising a main control valve disposed between the throttling valve and the second throttling valve on the one hand and the actuator on the other hand with respect to flow of the fluid, wherein the main control valve includes a spool that determines, based on its position, at least one of the direction and speed the workhead extends or retracts, and outputs of the throttling valve and the second throttling valve are respectively coupled to the spool.

10. The rail maintenance vehicle of claim 7, wherein the throttling valve and the second throttling valve are integrated in a single assembly.

11. The rail maintenance of claim 7, wherein the pilot valve is a three way solenoid valve having a first output coupled to the throttling valve and a second output coupled to the second throttling valve.

12. The rail maintenance vehicle of claim 1, wherein the pilot valve includes an orifice that receives the fluid, and an opening of the orifice is 0.8 mm.

13. The rail maintenance vehicle of claim 1, further comprising a pneumatic suspension disposed between a seat and the frame of the vehicle.

14. The rail maintenance vehicle of claim 1, wherein the workhead includes a tamping workhead that tamps ballast.

15. A method of operating a maintenance vehicle, comprising:

supplying fluid to a pilot valve;

supplying the fluid to a throttling valve that adjusts a pressure of the fluid at an output relative to a pressure of the fluid at an input; and controlling an actuator that extends and retracts a workhead relative to a frame of the vehicle using the fluid exiting the throttling valve.

16. The method of claim 15, further comprising supplying the fluid exiting the throttling valve to a main control valve disposed between the throttling valve and the actuator with respect to flow of the fluid, wherein the main control valve includes a spool that determines, based on its position, at least one of the direction and speed the workhead extends or retracts, and the throttling valve supplies the fluid to the spool.

17. The method of claim 15, wherein the throttling valve includes first and second throttling valves, the pilot valve includes a first output coupled to the first throttling valve and a second output coupled to the second throttling valve, and the method further comprises selectively directing the fluid, using the pilot valve, to one of the first and second throttling valves.

18. The method of claim 17, further comprising independently adjusting the first and second throttling valves.

19. The method of claim 18, further comprising adjusting the first throttling valve to a first setting, and adjusting the second throttling valve to a second setting that is more restrictive than the first setting.

20. The method of claim 15, wherein the supplying the fluid to the pilot valve includes supplying the fluid to the pilot valve by an engine driven pump.

* * * * *